US006239713B1

(12) United States Patent
Harvey et al.

(10) Patent No.: US 6,239,713 B1
(45) Date of Patent: May 29, 2001

(54) SENSOR MOUNTING ARRANGEMENT

(75) Inventors: John Herbert Harvey, Wolverhampton; Timothy Hudson, Telford; Jonathan Alan Darby, Newcastle, all of (GB)

(73) Assignee: Lucas Industries Limited, London (GB)

( * ) Notice: Subject to any disclaimer, the term of this patent is extended or adjusted under 35 U.S.C. 154(b) by 0 days.

(21) Appl. No.: 09/492,897

(22) Filed: Jan. 27, 2000

(30) Foreign Application Priority Data

Jan. 29, 1999 (GB) ..... 9901852

(51) Int. Cl.[7] ..... G08B 21/00

(52) U.S. Cl. ..... 340/686.3; 340/686.1; 340/679

(58) Field of Search ..... 340/686.3, 686.1, 340/686.2, 679, 680, 681, 682, 691.1; 73/866.5

(56) References Cited

U.S. PATENT DOCUMENTS

| | | | | |
|---|---|---|---|---|
| 3,786,695 | | 1/1974 | Barrett, Jr. | 74/586 |
| 3,901,128 | * | 8/1975 | Swogger | 91/31 |
| 4,762,003 | * | 8/1988 | Cioletti | 73/825 |
| 4,787,150 | * | 11/1988 | Klinginsmith, III | 33/552 |
| 4,838,173 | * | 6/1989 | Schroeder et al. | 246/187 R |
| 5,083,454 | * | 1/1992 | Yopp | 73/862.1 |
| 5,112,566 | * | 5/1992 | Butzin et al. | 376/245 |
| 5,211,061 | * | 5/1993 | Goodwin | 73/862.541 |
| 5,344,316 | * | 9/1994 | Hordijk et al. | 434/37 |
| 5,511,933 | * | 4/1996 | Herklotz | 414/749 |

FOREIGN PATENT DOCUMENTS

| | | |
|---|---|---|
| 0 336 775 | 10/1989 | (EP) . |
| 2 168 505 | 6/1986 | (GB) . |

* cited by examiner

*Primary Examiner*—Nina Tong
(74) *Attorney, Agent, or Firm*—Wells, St. John, Roberts, Gregory & Matkin P.S.

(57) ABSTRACT

A sensor mounting arrangement comprising a mounting component arranged, in use, to carry a moveable part of a sensor. The mounting component is coupled through a first load path to a drive component to move with the drive component. The mounting component includes an opening through which the drive component extends, the drive component defining an abutment surface which is spaced from the mounting component in normal use and is arranged such that, should the first load path fail, the abutment surface is moveable into engagement with the mounting component to transmit movement of the drive component to the part of the mounting component carrying the moveable part of the sensor through a second load path.

9 Claims, 1 Drawing Sheet

SENSOR MOUNTING ARRANGEMENT

BACKGROUND OF THE INVENTION

This invention relates to a sensor mounting arrangement for use in mounting the moveable part of a position sensor. In particular, the invention relates to an arrangement whereby, upon failure of a component of the arrangement, the sensor can continue to operate and the failure can be sensed.

Where a linear variable differential transformer (LVDT) is used to monitor, for example, the position of a piston rod, the moveable part of the LVDT is mounted upon a mounting component which is secured to and moveable with the piston rod. Should the mounting component break, then movement of the piston rod will not be transmitted through the mounting component to the LVDT and so will not be sensed, nor will a signal be produced indicative of the component failure. If the piston rod forms part of an actuator used in a safety critical application, for example in controlling the positions of the flaps or thrust reversers of an aircraft, then the component failure could be dangerous if it remained undetected.

BRIEF SUMMARY OF THE INVENTION

It is an object of the invention to provide a sensor mounting arrangement wherein the failure of a mounting component can be sensed, and wherein continued operation of the sensor is permitted.

According to the present invention there is provided a sensor mounting arrangement comprising a mounting component arranged, in use, to carry a moveable part of a sensor, the mounting component being coupled through a first load path to a drive component to move with the drive component, wherein the mounting component includes an opening through which the drive component extends, the drive component defining an abutment surface which is spaced from the mounting component in normal use and arranged such that, should the first load path fail, the abutment surface is moveable into engagement with the mounting component to transmit movement of the drive component to the part of the mounting component carrying the moveable part of the sensor through a second load path.

The coupling between the drive component and the mounting component conveniently allows angular movement between the components, but substantially prevents relative axial movement.

The abutment surface may be defined by a surface of a component, for example a lock nut, secured to the drive component.

Preferably, the sensor comprises an LVDT. In such an arrangement, the core of the LVDT may constitute the moveable part carried by the mounting component.

The mounting arrangement may be used to mount a plurality of sensors to monitor the position of or movement of, for example, a piston rod.

The invention will further be described, by way of example, with reference to the accompanying drawing which is a sectional view of a mounting arrangement in accordance with an embodiment of the invention.

DETAILED DESCRIPTION OF THE INVENTION

Figure 1:
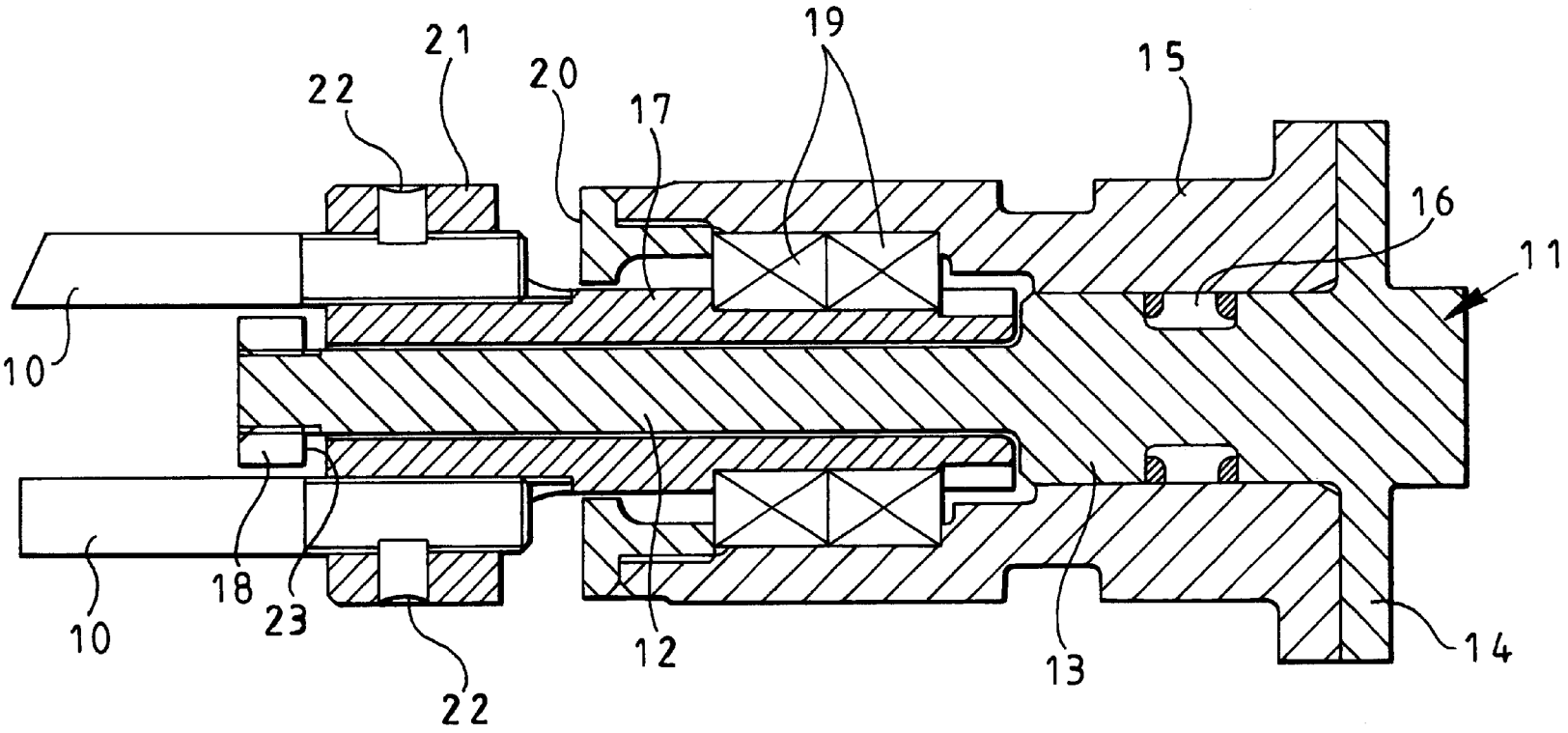
FIG. 1 shows the detail structure of the present invention.

The mounting arrangement illustrated in the accompanying drawing is intended for use in carrying the moveable parts of a plurality of position sensors. In particular, the arrangement illustrated in the accompanying drawing FIG. 1 is intended for carrying the cores 10 of a plurality of LVDT position sensors. The position sensors are intended for use in monitoring the position of a piston rod forming part of an actuator which may be used, for example, in controlling the operation of the flaps or thrust reversers of an aircraft. It will be appreciated, however, that the sensor mounting arrangement is suitable for use with other types of sensor and may be used in other applications.

The sensor mounting arrangement comprises a drive component 11 which is secured, in use, to the piston rod, the position of which is to be monitored. The drive component 11 takes the form of an elongate shaft of stepped form, including an elongate, relatively small diameter region 12 and a larger diameter region 13. An outwardly extending flange 14 is integral with the larger diameter region 13. Secured to the drive component 11 is a tubular coupling component 15. A seal arrangement 16 is located between the drive component 11 and the coupling component 15. The connection between the drive component 11 and the coupling component 15 is such that substantially no relative movement, either axial movement or angular movement, is permitted.

A mounting component 17 of tubular form extends around the relatively small diameter region 12 of the drive component 11. A screw-threaded nut 18 is secured to a screw-threaded end region of the small diameter region 12, the nut 18 also being welded to the drive component 11 to prevent release of the nut 18. The mounting component 17 and the coupling component 15 are each shaped to define annular grooves within which ball bearings are received to couple the mounting component 17 to the coupling component 15, and hence to the drive component 11. The bearings 19 defined by the provision of the ball bearings within the grooves act to permit relative angular movement between the drive component 11 and the mounting component 17, but to substantially prevent axial movement of the mounting component 17 relative to the drive component 11. A screw-threaded retainer member 20 is secured to the coupling component 15 to prevent release of the bearings 19. The retainer member 20 is conveniently also welded to the coupling component 15 to prevent release of the retainer member 20 from the coupling component 15.

The mounting component 17 is shaped to define an integral, outwardly extending flange 21 which is provided with a plurality of screw-threaded bores arranged to extend parallel to the axis of the mounting component 17. Each of the bores receives, in screw threaded engagement, a corresponding one of the cores 10. An appropriate retainer 22 is also associated with each of the cores 10 to prevent release of the cores 10 from the mounting component 17.

In the drawing, the components are illustrated in their normal operating condition. It will be apparent from the drawing that the nut 18 is spaced from the mounting component 17 in these circumstances.

In use, upon movement of the piston rod occurring, the drive component 11 will move with the piston rod. The movement of the drive component is transmitted through a first load path defined by the coupling component 15, the bearings 19 and the mounting component 17 to the cores 10. The position of or movement of the cores is sensed using the position sensors in the usual manner. It will be appreciated that although axial movement of the piston rod is transmitted to the mounting component 17, any angular movement of the drive component 11 is not transmitted, relative angular movement between the drive component 11 and the mounting component 17 being permitted by the bearings 19.

In the event that the first load path fails, for example as a result of the mounting component 17 fracturing, preventing movement of the drive component 11 from being transmitted through the coupling component 15, the bearings 19 and the mounting component 17 to the cores 10, it will be appreciated that movement of the drive component 11 will result in an end, abutment surface 23 of the nut 18 moving into engagement with the end surface of the mounting component 17. Once such engagement has occurred, continued movement of the drive component 11 will be transmitted to the cores 10 through a second load path defined by the relatively small diameter region 12 of the drive component 11 and the nut 18. As a result, it will be appreciated that a position reading can still be achieved using the position sensors. It will be appreciated, however, that the reading will be a little inaccurate as some movement of the piston rod must occur in order to bring the abutment surface 23 into engagement with the mounting component 17.

Where the sensor mounting arrangement is used in an aircraft application, by fully extending and retracting the actuator during the pre-flight tests, any error in the reading of the position sensors can be measured and used to determine whether or not the first load path has failed. When the actuator is in the fully extended or fully retracted position, the output from the position sensor can be compared to either a predetermined or previously measured sensor output for a correctly functioning actuator. In the event that the first load path has failed, there will be a difference between the predetermined sensor output and the measured sensor output and this difference can be used to indicate that a fault has occurred.

As well as sensing failure of the mounting component 17, it will be appreciated that the sensor mounting arrangement may also be used to sense the failure of the coupling component 15 or the bearings 19.

What is claimed is:

1. A sensor mounting arrangement comprising a mounting component arranged, in use, to carry a moveable part of a sensor, said mounting component being coupled through a first load path to a drive component to move with said drive component, wherein said mounting component includes an opening through which said drive component extends, said drive component defining an abutment surface which is spaced from said mounting component in normal use and is arranged such that, should said first load path fail, said abutment surface is moveable into engagement with said mounting component to transmit movement of said drive component to a part of said mounting component carrying said moveable part of said sensor through a second load path.

2. The sensor mounting arrangement as claimed in claim 1, wherein said coupling between said drive component and said mounting component is arranged to allow angular movement between said components, but substantially prevents relative axial movement.

3. The sensor mounting arrangement as claimed in claim 2, comprising a coupling component secured to said drive component, said coupling component being shaped to define grooves for receiving ball bearings to couple said mounting component to said coupling component.

4. The sensor mounting arrangement as claimed in claim 1, wherein said abutment surface is defined by a surface of a component secured to said drive component.

5. The sensor mounting arrangement as claimed in claim 4, wherein said component defining said abutment surface is a nut.

6. The sensor mounting arrangement as claimed in claim 1, wherein said sensor comprises an linear variable differential transformer (LVDT).

7. The sensor mounting arrangement as claimed in claim 6, wherein said LVDT has a core, said core constituting said moveable part of said sensor carried by said mounting component.

8. The sensor mounting arrangement as claimed in claim 1, for use in mounting a plurality of sensors to monitor position or movement of a piston rod.

9. The sensor mounting arrangement as claimed in claim 1, further comprising a detector for monitoring the output of said sensor so as to determine whether or not an error has occurred in said sensor output due to failure of said first load path.

* * * * *